US006721994B2

(12) United States Patent
Bowman et al.

(10) Patent No.: US 6,721,994 B2
(45) Date of Patent: Apr. 20, 2004

(54) DOOR HINGE WITH POSITIONING FEATURE AND METHOD

(75) Inventors: Terry Michael Bowman, Mebane, NC (US); Robert Bruce Wallace, Mebane, NC (US); Peter Donald Muse, Durham, NC (US); Gilbert Anthony Soares, Mebane, NC (US); Edgar Yee, Chapel Hill, NC (US)

(73) Assignee: General Electric Company, Schenectady, NY (US)

( * ) Notice: Subject to any disclaimer, the term of this patent is extended or adjusted under 35 U.S.C. 154(b) by 193 days.

(21) Appl. No.: 09/682,612

(22) Filed: Sep. 26, 2001

(65) Prior Publication Data

US 2003/0056321 A1 Mar. 27, 2003

(51) Int. Cl.[7] ..... E05D 7/10
(52) U.S. Cl. ..... 16/262; 16/267; 16/382
(58) Field of Search ..... 16/263, 261, 262, 16/266, 269, 380, 382, 387–391; 29/11, 407.09, 407.1, 464; 312/223.2, 265.1, 265.5, 265.6, 327; 174/48, 66, 67; 220/4.02, 835, 836, 841–845

(56) References Cited

U.S. PATENT DOCUMENTS 686,603 A * 11/1901 Gossett ..... 16/268
1,632,116 A * 6/1927 Buss ..... 16/267
2,677,147 A * 5/1954 Phillips ..... 16/266
3,591,247 A * 7/1971 Berry et al. ..... 312/304
3,979,817 A * 9/1976 Cheak ..... 29/434
4,065,027 A * 12/1977 Ruark et al. ..... 220/844
4,308,972 A * 1/1982 McReynolds et al. ..... 220/831
4,390,114 A 6/1983 Sviatoslavsky et al.
4,839,957 A * 6/1989 Jangaard ..... 29/434
4,979,264 A * 12/1990 Ramsauer ..... 16/264
5,076,455 A 12/1991 Begley
5,259,091 A 11/1993 Mordick
5,358,135 A 10/1994 Robbins et al.
6,081,968 A 7/2000 Walker et al.
6,122,813 A * 9/2000 Roy et al. ..... 29/407.09
6,321,414 B1 * 11/2001 Buchanan et al. ..... 16/257
6,438,800 B1 * 8/2002 Narang et al. ..... 16/389

FOREIGN PATENT DOCUMENTS

FR 2814321 A3 * 8/2001
JP 7-283552 * 10/1995

* cited by examiner

*Primary Examiner*—Chuck Y. Mah
(74) *Attorney, Agent, or Firm*—Cantor Colburn LLP

(57) ABSTRACT

A hinge for mounting a door to an enclosure includes a first leaf, a second leaf, and a pin. The first leaf includes a first tongue attached to a surface formed on one of the door or the enclosure, and a first knuckle depending from the first tongue. The first knuckle includes a tab depending therefrom, and the tab extends through an aperture in a flange depending from the surface. The second leaf includes a second tongue coupled to another of the door or the enclosure, and a second knuckle coupled to the second tongue. The pin extends through the first and second knuckles. A method of assembling a hinge to a door includes: extending a portion of the hinge within an aperture in the door; applying a magnetic force to the portion of the hinge to secure the portion of the hinge within the aperture; and securing the hinge to the door with a fastener while applying the magnetic force.

19 Claims, 3 Drawing Sheets

DOOR HINGE WITH POSITIONING FEATURE AND METHOD

BACKGROUND OF INVENTION

Enclosures often include doors or covers that are pivotally secured to a frame of the enclosure. In enclosures constructed of metal, such hinges are typically secured to the door and the frame by welding. During the welding process, however, the hinges are difficult to position with respect to the cabinet frame. In addition, the hinges are difficult to align square to the door edge. To overcome these problems, door hinge locating fixtures are used to properly position the hinge and door relative to the frame. Problematically, where the construction of one or more cabinets requires the use of a number of locating fixtures, the wrong locating fixture can selected when the door hinges are to be welded. Selection of an improper locating fixture, or an attempt to construct the electrical enclosure without the use of a locating fixture can lead to numerous problems. Such problems include: the door will not close properly due to an interference, the hinge pins will be difficult or impossible to install, the alignment of the door to the frame will be incorrect—giving the appearance of poor quality, the door will be difficult to open and close and latches may be difficult to engage, door sealing may be inadequate.

SUMMARY OF INVENTION

The above described and other drawbacks and deficiencies of the prior art are overcome or alleviated by a hinge for mounting a door to an enclosure. The hinge includes a first leaf, a second leaf, and a pin. The first leaf includes a first tongue attached to a surface formed on one of the door or the enclosure, and a first knuckle depending from the first tongue. The first knuckle includes a tab depending therefrom, and the tab extends through an aperture in a flange depending from the surface. The second leaf includes a second tongue coupled to another of the door or the enclosure, and a second knuckle coupled to the tongue. The pin extends through the first and second knuckles.

In an alternative embodiment, a method of assembling a hinge to a door includes: extending a portion of the hinge within an aperture in the door; applying a magnetic force to the portion of the hinge to secure the portion of the hinge within the aperture; and securing the hinge to the door with a fastener while applying the magnetic force.

BRIEF DESCRIPTION OF DRAWINGS

The invention will now be described by way of the Figures in which like elements are numbered alike, wherein.

DETAILED DESCRIPTION

Figure 1:
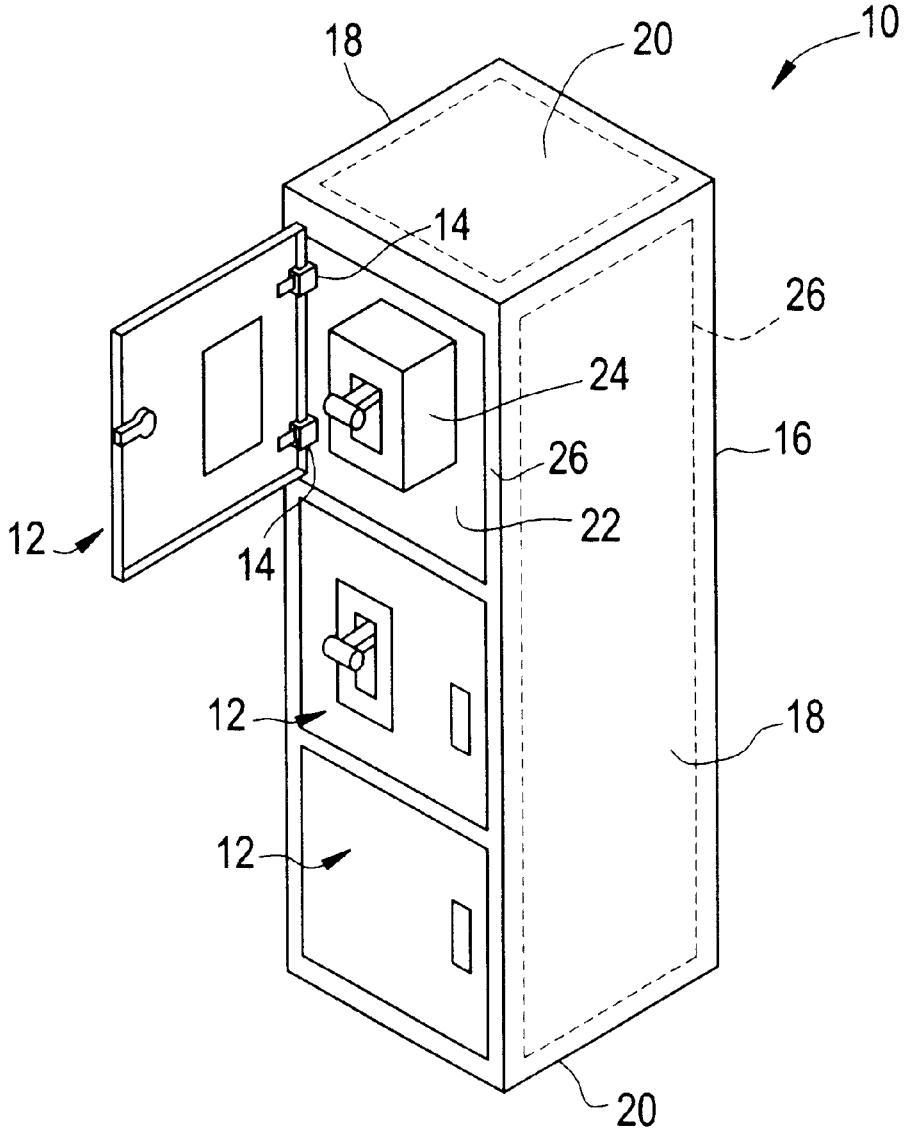
FIG. 1 is a perspective view of an electrical enclosure including a welded hinge.

Referring to FIG. 1, a perspective view of an assembled electrical enclosure 10 is shown with doors 12 pivotally attached thereto by hinges 14. Enclosure 10 is a generally parallelepipedic structure including a back wall 16, two side walls 18, a top 20, and a bottom 21, which form an internal space 22 for mounting electrical power distribution devices 24 such as circuit breakers, motor controllers, electronics, and the like. Supporting back wall 16, side walls 18, top 20, and bottom 21 is a frame 26.

Figure 2:
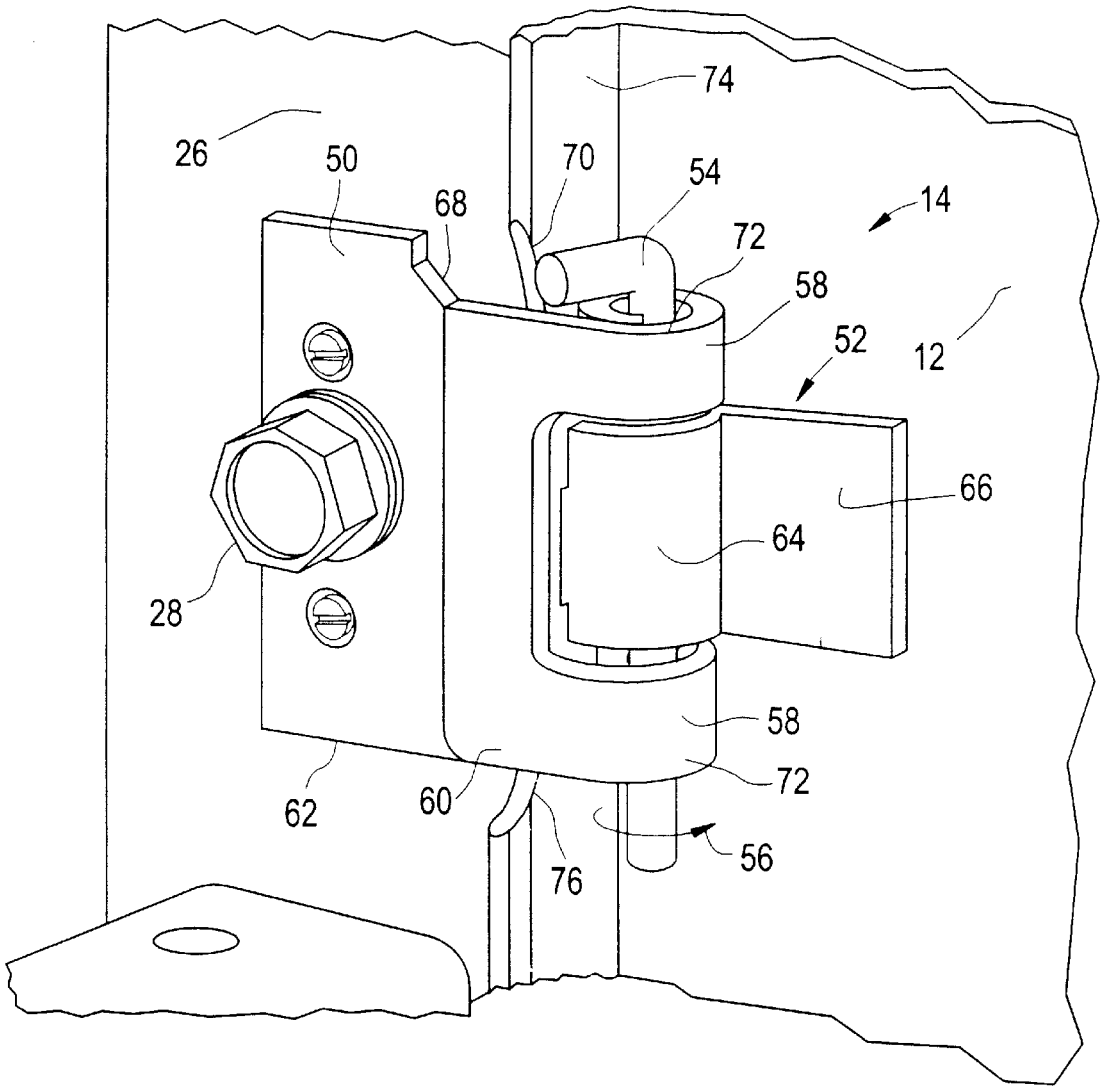
FIG. 2 is a perspective view of the hinge of FIG. 1.

Referring to FIG. 2, a perspective view of an assembled hinge 14 is shown. Hinge 14 includes a leaf 50, which is secured to frame 26, a leaf 52, which is secured to door 12, and a pin 54 that extends between leaf 50 and leaf 52. Pin 54 pivotally secures leaf 52 to leaf 50, thereby allowing door 12 to pivot about pin 54 in a direction indicated by arrow 56.

Leaf 50 includes a pair of knuckles 58 extending from a recessed portion 60, which extends from a tongue 62. Tongue 62 is secured to an interior portion of frame 26 by a fastener 28. Tongue 62 can be secured to frame 26 by welding, riveting, mechanical fastening, or the like.

In general, a knuckle of a hinge is a portion of the hinge that receives a hinge pin. In the embodiment of FIG. 2, knuckles 58 are hollow cylindrical structures configured to receive pin 54. Knuckles 58 are spaced apart, with the space between knuckles 58 receiving a knuckle 64 of leaf 52. Knuckle 64 extends from a tongue 66, which is secured to the interior portion of door 12 by welding, riveting, mechanical fastening, or the like. Knuckles 58 and 64 are shaped to create an aperture that extends continuously between knuckles for accepting pin 54.

Recessed portion 60 is generally "C"shaped, including a section 68 that angularly depends from tongue 62, a section 70 depending from section 68 that extends generally parallel to tongue 62, and a section 70 that perpendicularly depends from section 72 and attaches to knuckles 58. Recessed portion 60 accepts a flange 74 that extends from the perimeter of the door 12. Flange 74 has a notched section 76 proximate recessed portion 70 of hinge 14. Together, recessed portion 70 and notched section 76 provide clearance to allow door 12 to pivot around pin 56 in the direction indicated by arrow 56 until notched section 76 contacts section 72 of hinge 14. Preferrably, knuckles 58, recessed portion 60, and tongue 62 are formed from a continuous piece of metal. While the embodiment shown in FIG. 2 shows leaf 50 secured to frame 26 and leaf 52 secured to door 12, it will be recognized that where frame 26 includes a flange similar to flange 74, leaf 52 can be secured to frame 26 and leaf 52 can be secured to door 12.

Figure 3:
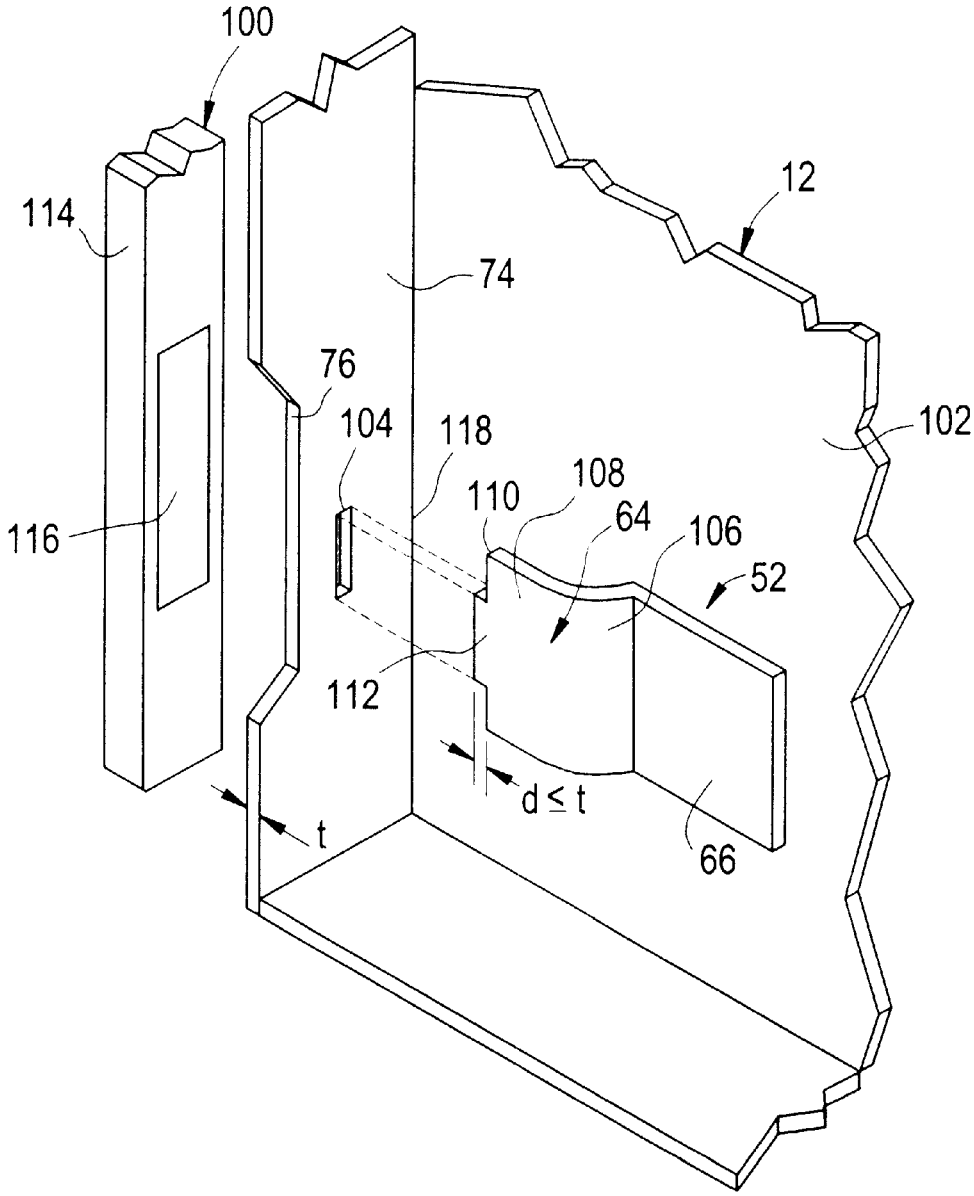
FIG. 3 is an exploded perspective view of a door portion of hinge and a magnetic locating fixture.

Referring now to FIG. 3, an exploded view of door 12 and leaf 52 of hinge 14 are shown along with a magnetic locating fixture 100. Door 12 includes a generally planar surface 102 formed from a sheet of material having a generally uniform thickness "t" and having flange 74 formed around its perimeter. Flange 74 includes an aperture 104 formed therein proximate notched section 76.

Leaf 52 of hinge 14 includes tongue section 66 coupled to knuckle section 64. Tongue section 66 is a generally flat plate that is secured to surface 102 of door 12 by one or more fasteners (not shown) such as bolts, screws, welding, riveting, or the like. Knuckle section 64 includes a portion 106 angularly depending from tongue 66, and a portion 108 extending generally parallel to tongue 66. Depending from an end 110 of portion 108 is a tab 112. Tab 112 extends from end 110 a distance "d" which is less than or equal to the thickness "t" of door.

Magnetic locating fixture 100 includes a rod 114 that extends along flange 74 proximate leaf 52 of hinge 14. Disposed within rod 114 is one or more magnets 116. Each magnet 116 is positioned proximate to a leaf 52 of hinge 14.

During assembly, tongue 66 is placed flat against surface 102 of door 12 and tab 112 is inserted in aperture 104. Magnetic locating fixture 100 is then placed on a side of flange opposite leaf 52 of hinge 14. The magnetic force from magnet 116 acts on tab 112 and draws tab 112 into aperture 104 until end 110 abuts against flange 74. The magnetic force holds leaf 52 of hinge 14 in place while tongue 66 is fastened onto surface 102 of door 12. When leaf 52 of hinge 14 is assembled to door 12, an aperture is formed between knuckle section 64 and a corner 118 formed between surface 102 and flange 74. This aperture accepts pin 54 (FIG. 2) for pivotally securing leaf 52 of hinge 14 to leaf 50 of hinge 14.

Referring to FIGS. 2 and 3, the placement of aperture 104 in flange 74 ensures that the leaf 52 of hinge 14 is positioned so that it correctly mates with the leaf 50 of hinge 14. The magnetic locating fixture 100 ensures that the leaf 52 of the hinge 14 is mounted squarely on the door 12. Because the position of leaf 52 of hinge 14 is determined by aperture 104 and not by the locating fixture 100, it is impossible for a technician to improperly attach the hinge 14 by selecting the wrong fixture, as is possible with hinge mounting fixtures of the prior art. In addition to ensuring proper placement of hinge 14, the interaction between tab 112 and flange 74 provide strength to the hinge 14.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments failing within the scope of the appended claims.

What is claimed is:

1. A hinge for mounting a door to an enclosure, the hinge comprising:

a first leaf including a first tongue attached to a surface formed on one of the door or the enclosure;

a first knuckle depending from said first tongue, said first knuckle including a tab depending therefrom, said tab extending through an aperture in a flange depending from said surface;

a second leaf including a second tongue coupled to another of the door or the enclosure;

a second knuckle coupled to the second tongue; and a pin extending through said first and second knuckles.

2. The hinge of claim 1, wherein said first knuckle includes:

a first portion angularly depending from said first tongue;

a second portion depending from said first portion and extending parallel to said first tongue, said tab extends from an end of said second portion; and wherein said pin is received between said first and second portions, said surface, and said flange.

3. The hinge of claim 1, wherein said second tongue and said second knuckle are coupled by a recessed portion, said recessed portion receiving said flange.

4. The hinge of claim 3, wherein said recessed portion includes:

a first section angularly depending from said second tongue;

a second section depending from said first section, said second section extending parallel to said second tongue; and a third section perpendicularly depending from said second section and attaching to said second knuckle.

5. The hinge of claim 4, wherein said flange includes a notched section proximate said recessed portion.

6. An enclosure comprising:

a door;

a frame; and a hinge for pivotally mounting said door to said frame, said hinge including a first leaf including a first tongue attached to a surface formed on one of the door or the enclosure;

a first knuckle depending from said first tongue, said first knuckle including a tab depending therefrom, said tab extending through an aperture in a flange depending from said surface;

a second leaf including a second tongue coupled to another of the door or the enclosure;

a second knuckle coupled to the second tongue; and a pin extending through said first and second knuckles.

7. The enclosure of claim 6, wherein said first knuckle includes:

a first portion angularly depending from said first tongue;

a second portion depending from said first portion and extending parallel to said first tongue, said tab extends from an end of said second portion; and wherein said pin is received between said first and second portions, said surface, and said flange.

8. The enclosure of claim 7, wherein said second tongue and said second knuckle are coupled by a recessed portion, said recessed portion receiving said flange.

9. The enclosure of claim 8, wherein said recessed portion includes:

a first section angularly depending from said second tongue;

a second section depending from said first section, said second section extending parallel to said second tongue; and a third section perpendicularly depending from said second section and attaching to said second knuckle.

10. The enclosure of claim 9, wherein said flange includes a notched section proximate said recessed portion.

11. The enclosure of claim 6, wherein said hinge is secured to said frame via a single fastener.

12. A method of assembling a hinge to a door, the method comprising:

extending a portion of the hinge within an aperture in the door;

applying a magnetic force to the portion of the hinge to secure the portion of the hinge within the aperture; and securing the hinge to the door with a fastener while applying the magnetic force;

wherein said applying the magnetic force includes:

positioning a magnet on a side of the flange opposite the portion.

13. The method of claim 12, wherein said fastener is selected from the group including: a weld, a rivet, a bolt, and a screw.

14. The method of claim 12, wherein the door includes a surface and a flange depending from the surface, the aperture is formed in the flange, and the hinge is secured to the surface by the fastener.

15. A method of assembling a hinge to a surface, said surface having a flange depending therefrom, said method comprising:

placing a leaf of the hinge on a first side of the flange;

disposing a tab extending from the leaf into an aperture formed in the flange;

holding the tab within the aperture with a magnetic force; and fastening the leaf to the surface while holding the tab within the aperture with the magnetic force.

16. The method of claim 15, wherein said holding the tab within the aperture with the magnetic force includes:

applying a magnet to a second side of the flange opposite the first side.

17. The method of claim 15, wherein said fastening the leaf to the surface includes one of:

bolting the leaf to the surface;

riveting the leaf to the surface; or welding the leaf to the surface.

18. The method of claim 15, wherein the leaf includes a knuckle extending from a tongue, the tab extends from the knuckle, and said fastening the leaf to the surface includes fastening the tongue to the surface.

19. An apparatus comprising:

a door;

a frame;

a hinge for pivotally mounting said door to said frame, said hinge including a first leaf and a second leaf;

said first leaf including a first tongue attached to said door and a first knuckle depending from said first tongue, said first knuckle including a tab depending therefrom, said tab extending through an aperture of said door;

said second leaf including a second tongue attached to said frame and a second knuckle depending from said second tongue; and a pin coupling said first and second knuckles;

wherein said second leaf is attached to said frame via a single fastener.

* * * * *